US006371862B1

(12) United States Patent
Reda

(10) Patent No.: US 6,371,862 B1
(45) Date of Patent: Apr. 16, 2002

(54) GAME APPARATUS AND METHOD

(76) Inventor: Kenneth Reda, 425 Church St., Bound Brook, NJ (US) 08805

( * ) Notice: Subject to any disclaimer, the term of this patent is extended or adjusted under 35 U.S.C. 154(b) by 0 days.

(21) Appl. No.: 09/419,085

(22) Filed: Oct. 15, 1999

(51) Int. Cl.[7] ..... A63B 69/36

(52) U.S. Cl. ..... 473/199; 473/198; 473/221; 473/222; 473/225; 473/407

(58) Field of Search ..... 473/198–199, 473/221–222, 225, 150, 154–157, 454–456, 407

(56) References Cited

U.S. PATENT DOCUMENTS

| | | | | |
|---|---|---|---|---|
| 3,157,399 A | * | 11/1964 | Gaudet | 273/26 |
| 3,558,140 A | * | 1/1971 | Romeo | 273/181 |
| 3,759,528 A | * | 9/1973 | Christophers et al. | 273/185 |
| 4,858,934 A | * | 8/1989 | Ladick et al. | 273/186 A |
| 5,056,791 A | * | 10/1991 | Poillon et al. | 273/185 B |
| 5,221,082 A | * | 6/1993 | Curchod | 273/185 A |
| 5,333,874 A | * | 8/1994 | Arnold et al. | 273/185 B |
| 5,354,063 A | * | 10/1994 | Curchod | 273/185 B |
| 5,390,927 A | * | 2/1995 | Angelos | 273/185 A |
| 5,820,496 A | * | 10/1998 | Bergeron | 473/455 |
| 5,826,874 A | * | 10/1998 | Teitell et al. | 473/225 |
| 5,846,139 A | * | 12/1998 | Bair et al. | 473/156 |
| 5,885,168 A | * | 3/1999 | Bair | 473/278 |
| 5,906,547 A | * | 5/1999 | Tynan | 473/199 |
| 5,984,794 A | * | 11/1999 | Miremadi | 473/199 |

FOREIGN PATENT DOCUMENTS

| | | | |
|---|---|---|---|
| EP | 0184410 A2 | * | 6/1986 |
| GB | 2001500 A | * | 1/1979 |
| GB | 2154146 A | * | 9/1985 |

* cited by examiner

*Primary Examiner*—Valencia Martin-Wallace
*Assistant Examiner*—Carmen D. White
(74) *Attorney, Agent, or Firm*—Thomas L. Adams

(57) ABSTRACT

A game apparatus and method can determine flight characteristics of an object propelled by a player from a launch site toward a backstop. The foregoing can operate with a launch detector located at the launch site for producing a launch signal in response to launching of the object. A backstop sensing arrangement may be employed at the backstop having at least one spaced pair of sensors for producing a pair of arrival signals in response to arrival of the object at the backstop. A processor may be employed, which is coupled to the launch detector and the backstop sensing arrangement. The processor can (a) determine the relative response times of the launch detector and the backstop sensing arrangement, and (b) produce a characteristic signal as a function of the relative arrival times of the pair of arrival signals.

42 Claims, 7 Drawing Sheets

FIG. 10
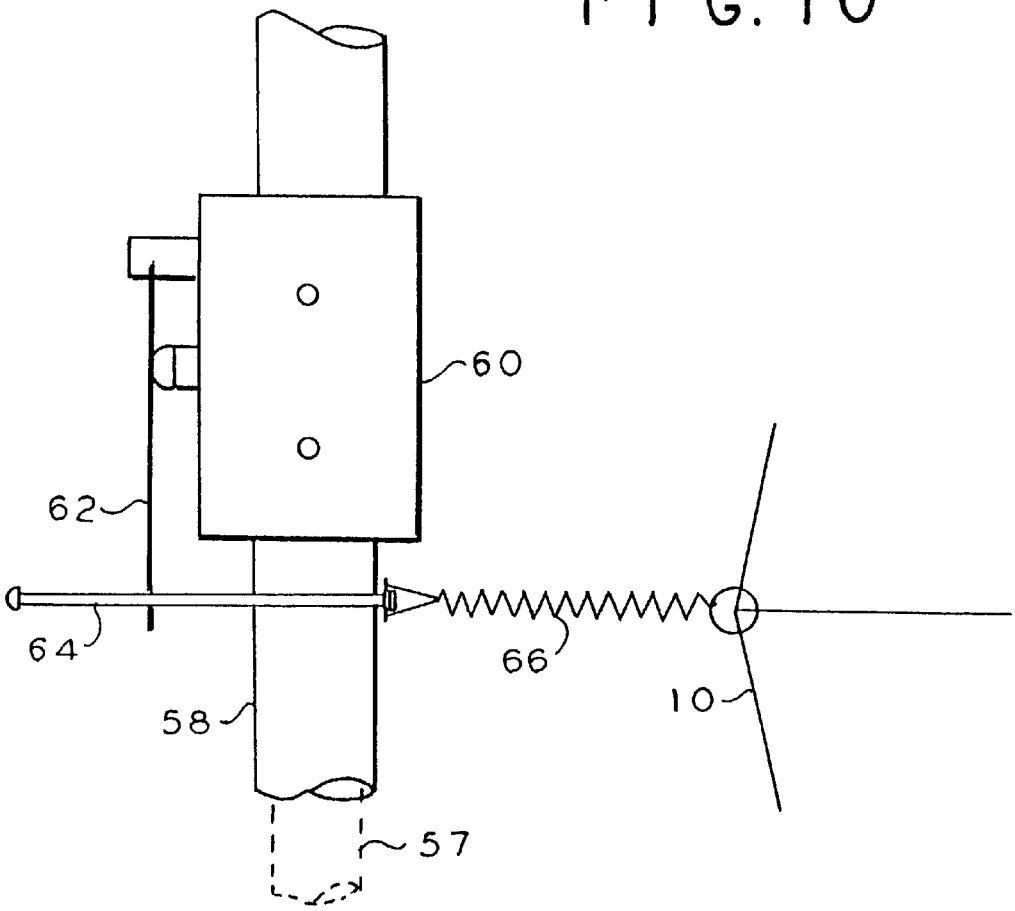
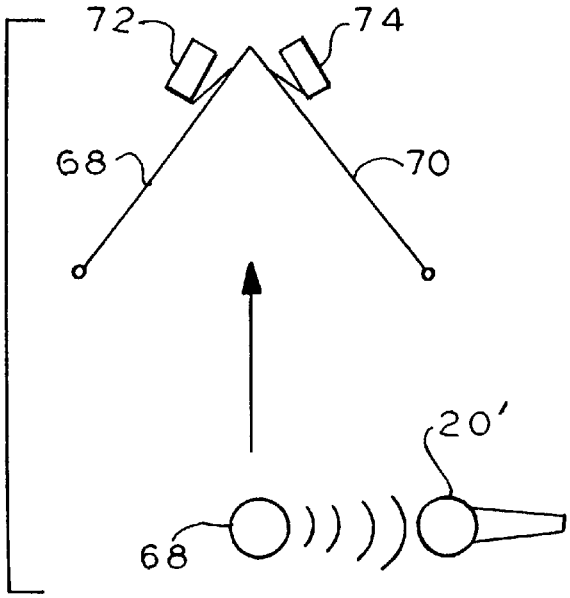
FIG. 11

GAME APPARATUS AND METHOD

BACKGROUND OF THE INVENTION

1. Field of the Invention

The present invention relates to game apparatus and methods, and in particular, to techniques responsive to a moving object propelled by a player toward a backstop.

2. Description of Related Art

Various means have been explored to measure speed and direction of a golf ball struck in a confined area. Many devices infer the ball trajectory information without the ball actually being set into flight. Several prior art devices utilize tethered balls and axle rotational speed or force measurements to provide estimates of the carry distance and/or direction. This target ball is often lighter and does not leave the tee unhindered, resulting in a different "feel" for the golfer. Also, a club swung too high can result in damage to the club as the head may become entangled in the tether.

Other devices use magnetic or optical devices to measure the club head speed and orientation. There is a need to add a magnetic strip or reflector to the club head with these devices. Another disadvantage is that the actual ball flight is inferred, not measured. A missed ball can indicate a "good" drive in some implementations.

In U.S. Pat. No. 5,826,874 magnetic sensors determine the path of a club head that is fitted with a magnet. Measurements are difficult over these short distances and at these high speeds. Moreover, this system provides only a rough estimate, since the trajectory of the club head does not unequivocally determine the flight path of the ball.

Most commercial simulation systems use infrared (IR), radar or optical planes to measure the ball trajectory, but these systems are cost prohibitive for personal use.

Several prior art devices exist for measuring impact location using grid wires or optical detectors. These devices require a large number of detectors and wires, which are costly.

Other devices employ a small number of linear displacement sensors on a net. Timing measurements along with deflection magnitudes provide the speed and direction information. These sensors are relatively costly and analog signal processing is required.

In U.S. Pat. No. 5,779,241 a number of cords are arranged in a grid within a net. The ends of each of the cords are wound on spring-biased reels inside sensors designed to respond to the linear extension of the cords, as caused by impact by a golf ball. The intersection of cords exhibiting the highest extension determines the point of impact on the net. Velocity can be estimated by analyzing the signals produced by the sensors. This system is relatively complex in that it requires a large number of sensors and the analysis of a correspondingly large number of signals.

In U.S. Pat. No. 5,820,496 the four corners of a net are supported by spring-biased cords. Four linear displacement sensors can measure motion of these cords, as caused by a ball impacting the net. It is difficult to accurately measure linear distances in this fashion. Also, these measurements are resolved by relatively elaborate mathematics, in order to determine the ball position and velocity at the net. Manipulating the outputs of these sensors is still too complicated.

Other devices use multiple microphones where the finite speed of sound allows impact location to be determined. The target must generate a sound upon impact, and thus is not suited for use with a conventional driving net.

Some golf simulation devices have been described which use an acoustic sensor to detect club impact as well as net switches to detect target impact time, but no means to use switch actuation times to determine impact location have been described.

In U.S. Pat. No. 4,086,630 a golf ball's flight time to a net is determined by a sensor at the golf tee and sensors at the net. The net sensors are relatively sensitive and are connected together to provide a signal on a single line. Less sensitive zone sensors at the net provide a number of separate signals for determining if the ball has deviated from a straight-ahead path. The quantized zone signals are used to degrade the calculated distance, depending upon the amount of deviation from a straight-ahead path. This system is relatively complicated in that it requires a number of zone sensors for determining flight azimuth, together with other sensors at the net for determining flight time.

In U.S. Pat. No. 3,938,809 a counting device issues timing pulses between the time of impact of the ball with (1) the club head, as detected by an acoustic sensor, and (2) the net, as detected by a number of parallel switches. This system is unable to determine whether or not the flight of the ball is straight-ahead.

Once the speed and direction of a golf ball is determined, graphic simulation of play on a course can be provided with a computer. A popular package called Links by Access™ exemplifies how play on a course is simulated.

The graphics are entertaining and realistic, but there is no true measurement of golfing ability, as speed and direction are input with a mouse-controlled timer.

The above mentioned U.S. Pat. No. 5,826,874 shows a device using magnetic sensors to determine head speed and direction. This device then implements software to mimic a mouse input to deliver the just measured parameters to the popular software package (Links by Access™). The electronics of this system are relatively complex, and the ball speed and direction are inferred just from the club head speed and orientation, without actually sending a ball in flight.

Accordingly, there is in need for an effective system that can determine flight characteristics of an object propelled by a player, with relatively simple and reliable detection techniques that will make the system available to consumers or other users.

PATENT REFERENCES

| Patent No. | Date | Inventor | Comments |
|---|---|---|---|
| 3938809 | Feb-76 | Gentiluomo | Conventional counter simulation |
| 4009883 | Mar-77 | Yellowlees et al. | Intensity of sound gives velocity |
| 4070018 | Jan-78 | Hodges | Grid sensors |
| 4071250 | Jan-78 | Vroome | Mechanical chain gives direction and distance |
| 4086630 | Apr-78 | Speiser et al. | Conventional counter simulation |
| 4165879 | Aug-79 | Zabel, Jr. | Handle weight, string |
| 4437672 | Mar-84 | Armantrout et al. | Simulation using optical sensors |
| 4511146 | Apr-85 | Windall | Position and clutch for maximum force, mechanical |
| 4615526 | Oct-98 | Yasuda et al. | Magnetic head sensors |
| 4801880 | Jan-89 | Koike | Tennis speed, sound detection |
| 4822042 | Apr-89 | Landsman | Tennis racket, shock wave |
| 4836551 | Jun-89 | LaSalle | Simulation using radar |
| 4844469 | Jul-89 | Yasuda et al. | Magnetic head sensors |
| 4848769 | Jul-89 | Bell et al. | Ball magnet coil voltage |
| 4958836 | Sep-90 | Onozuka et al. | Teather |

-continued

PATENT REFERENCES

| Patent No. | Date | Inventor | Comments |
|---|---|---|---|
| 4993709 | Feb-91 | Tominaga | Tennis speed using doppler |
| 5056791 | Oct-98 | Poillon et al. | Sound detection |
| 5062641 | Nov-91 | Poillon et al. | Multiple acoustic sensors, timing gives position. Magnitude gives velocity. |
| 5092602 | Mar-92 | Witler et al. | Doppler |
| 5178393 | Jan-93 | Dennesen | Teather |
| 5246232 | Sep-93 | Eccher et al. | Radar |
| 5277426 | Jan-94 | Gerpheide et al. | Standard protocol for major systems; uses radar |
| 5290037 | Mar-94 | Witler et al. | Radar |
| 5303924 | Apr-94 | Kluttz et al. | Impact area sensors, triangulation gives speed, and simulates roll |
| 5333874 | Aug-94 | Arnold et al. | IR sensor |
| 5336959 | Aug-94 | Park et al. | Grid and conductive film areas |
| 5374063 | Dec-94 | Ogden | Light on club head |
| 5375832 | Dec-94 | Witler et al. | Radar |
| 5390927 | Feb-95 | Angelos | Head sensors for impact angle, simulation |
| 5401018 | Mar-95 | Kelly et al. | Optical, baseball system |
| 5401026 | Mar-95 | Eccher et al. | Radar |
| 5419549 | May-95 | Galloway et al | Grid plus radar, baseball system |
| 5419565 | May-95 | Gordon et al. | Baseball system with grid; electro-mechanical |
| 5437457 | Aug-95 | Curchod | Optical sensors and initial spin via magnets in ball |
| 5447315 | Sep-95 | Perkins | Multiple acoustic sensors, timing gives position. Magnitude gives velocity. |
| 5451059 | Sep-95 | Weis | Teather |
| 5472205 | Dec-95 | Bouton | Head sensor and analog signals to game card or digital PC interface |
| 5478077 | Dec-95 | Miyahara | 5 Microphones and timing |
| 5479008 | Dec-95 | Nishiyama et al. | Optical sensors |
| 5481355 | Jan-96 | Iijima et al. | Optical sensors |
| 5486002 | Jan-96 | Witler et al. | Radar |
| 5568250 | Oct-96 | Nishiyama et al. | Optical sensors |
| 5586940 | Dec-96 | Dosch et al. | Teather with force measured |
| 5614823 | Mar-97 | Katayama et al. | Head sensors |
| 5631558 | May-97 | Yoshida et al. | Optical sensors |
| 5634855 | Jun-97 | King | Head sensors, optical |
| 5700204 | Dec-97 | Teder | Radar |
| 5718639 | Feb-98 | Bouton | Head sensors, light detectors, PC game |
| 5768151 | Jun-98 | Lowy et al. | 2 video cameras; 3D |
| 5779241 | Jul-98 | D'Costa et al. | Linear displacement; drums generate voltage |
| 5779555 | Jul-98 | Nomura et al. | Acceleration; club |
| 5806848 | Sep-98 | Edward | Time beween two sounds |
| 5820496 | Oct-98 | Bergeron | Linear displacement sensors |
| 5826874 | Oct-98 | Teitell et al. | Links Access ™ Interface |
| 5846139 | Dec-98 | Bair et al. | IR |

SUMMARY OF THE INVENTION

In accordance with the illustrative embodiments demonstrating features and advantages of the present invention, there is provided a game apparatus for determining flight characteristics of an object propelled by a player from a launch site toward a backstop. The apparatus includes a launch detector located at the launch site for producing a launch signal in response to launching of the object. Also included is a backstop sensing means located at the backstop and having at least one spaced pair of sensors for producing a pair of arrival signals in response to arrival of the object at the backstop. The apparatus also includes a processing means coupled to the launch detector and the backstop sensing means. The processing means can (a) determine the relative response times of the launch detector and the backstop sensing means, and (b) produce a characteristic signal as a function of the relative arrival times of the pair of arrival signals.

In accordance with another aspect of the invention a game method is provided for determining flight characteristics of an object propelled by a player from a launch site toward a backstop having a spaced pair of backstop sensors.

The method includes the step of producing a launch signal in response to launching of the object. Another step is determining the relative time between the launch signal and the response of at least one of the pair of backstop sensors. The method also includes the step of generating a characteristic signal as a function of the relative response times of the pair of backstop sensors.

Apparatus and methods of the foregoing type are described herein for determining the drive distance and direction of a golf ball (or other object) driven into a backstop or net. Club to ball impact detected by a preferred microphone starts the sequence. Ball to net (backstop) impact preferably actuates multiple sensors attached to the sides of the net. Preferably, the times from club impact to switch activation are analyzed to determine velocity, direction and carry distance, and to simulate a game of golf.

It is an object of the invention to provide a cost effective apparatus that can provide carry distance and directional information upon driving an object such as a golf ball into a backstop or net.

It is another object to provide a simple means, preferably employing switches at a net for determining time of flight from tee to net, and to correlate this to drive distance and to indicate direction; for example, hook/slice information derived by local signal processing circuitry with or without a computer.

In one embodiment a system captures time counted from tee impact to triggering of multiple net switches. The counts obtained thereby may be transferred to a personal computer for further data analysis and for displaying velocity, deviation angle from center, loft angle, and carry distance.

In one preferred embodiment, software will be employed for directly determining the times from tee to net switches, thus eliminating most of the required counter circuitry.

Preferably, the apparatus can determine the accuracy and speed of a putt with a ground-level backstop with two switches and an acoustic sensor.

A preferred computer can maintain information about ball position after each shot. The player's object will then be to get to the green or hole in a minimum number of strokes. In one preferred embodiment, the measured parameters are transferred to commercially available software for simulation of play on a course.

A number of embodiments are anticipated utilizing switches on a golf net for velocity and direction feedback. The most cost effective embodiment of the present invention adds two switches to any golf net, a microphone near the tee, a small circuit comprising a comparator-triggered flip-flop and a 25-pin D connector, a software driver to acquire the timing information in the PC, software to calculate velocity, distance, direction and final ball position, and software to play a simple game from tee to green. Software to additionally interface with game simulation software such as the Links Access™ simulation software can also be provided, along with the option to simulate putting.

Real time sensor acquisition may not, however, be desirable or possible with all PCs and all operating systems, and it is desired to offer some level of local processing as well as data transfer to a PC. Thus one preferred embodiment described below will include an arrangement with a discrete counter and latches, as well as putting apparatus and software for a simple golf game.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 10 is an elevational view of the backstop sensing means that may be used in the systems of FIGS. 1, 6, 8, and 9; and FIG. 11 is a schematic plan view of a putting arrangement that may be used in connection with the foregoing apparatus and methods.

DETAILED DESCRIPTION OF THE PREFERRED EMBODIMENTS

FIGS. 1, and 2A–C, illustrate how switch actuation time difference can yield position. Backstop 10 may be a conventional golf net supported by a frame (described further hereinafter). Coupled to the center of the left and right edges of backstop 10 are a pair of backstop sensing means 12 and 14. While described further hereinafter, sensing means 12 and 14 are sensor switches that respond to stretching forces on the net 10 caused by net deflection caused, for example, by a golf ball normally impacting the net.

Figure 1:
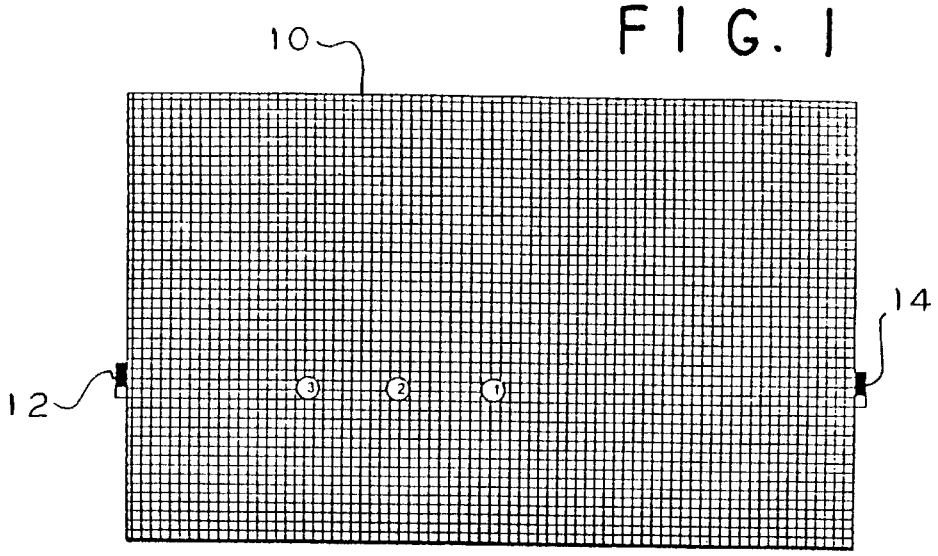
FIG. 1 is an elevational view of a backstop and sensing means employed with the apparatus and method of the present invention.
Figure 2A:
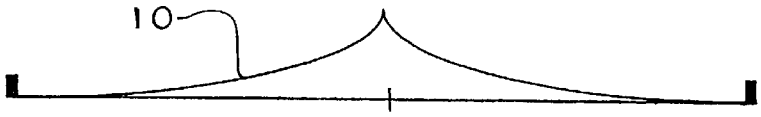
FIGS. 2A, 2B, and 2C are schematic plan views showing the deflections required to actuate the right and left sensing means of FIG. 1 for positions 1, 2, and 3, respectively.
Figure 2B:
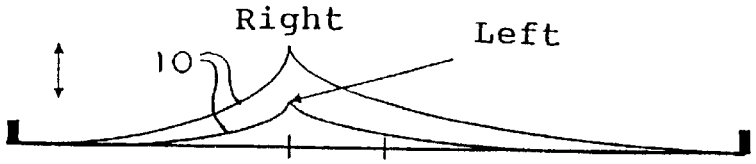
Figure 2C:
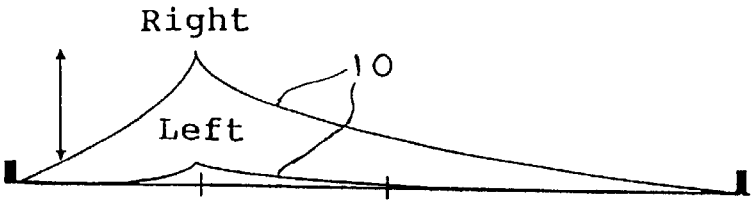

The basis for position calculation can be determined from two quick, successive measurements. The trip points of switch sensors 12 and 14 are adjusted on either side of the net 10 so that pushing the center of the net 10 inward at the switch height causes both the left and right switches 12 and 14 to actuate at about the same time and deflection distance (FIG. 2A, and position 1 of FIG. 1). Furthermore, if one slowly pushes in the net at a lateral position (x) one foot to the left of center (FIG. 2B, and position 2 of FIG. 1), one will find that the left switch 12 actuates first, followed by the right switch 14 after perhaps an additional two inches of net deflection (z). FIG. 2B illustrates this difference in deflection (deflection difference Dz) by showing the deflection occurring when the left switch sensor 12 actuates (lower profile), and the deflection occurring when the right switch sensor 14 actuates (upper profile). If one doubles the distance from center (FIG. 2C, and position 3 of FIG. 1), one will roughly double the additional deflection distance required to actuate the second switch. The same phenomenon will be found with deflection on the other side of center, but with the switch order reversed. Table 1 gives empirical data from a constructed net.

TABLE 1

| Switch Actuation (z) vs. Lateral Offset (x) | | | |
|---|---|---|---|
| x | Left (z) | Right (z) | Left-Right (Dz) |
| −2.5 | 7.10 | 10.00 | −2.90 |
| −2.0 | 7.50 | 10.25 | −2.75 |
| −1.5 | 8.00 | 10.00 | −2.00 |
| −1.0 | 9.00 | 10.50 | −1.50 |
| −0.5 | 9.50 | 10.00 | −0.50 |
| 0.0 | 10.00 | 10.00 | 0.00 |
| 0.5 | 9.90 | 8.75 | 1.15 |
| 1.0 | 11.00 | 9.00 | 2.00 |
| 1.5 | 11.50 | 9.00 | 2.50 |
| 2.0 | 11.25 | 8.00 | 3.25 |
| 2.5 | 11.00 | 7.25 | 3.75 |

Figure 3:
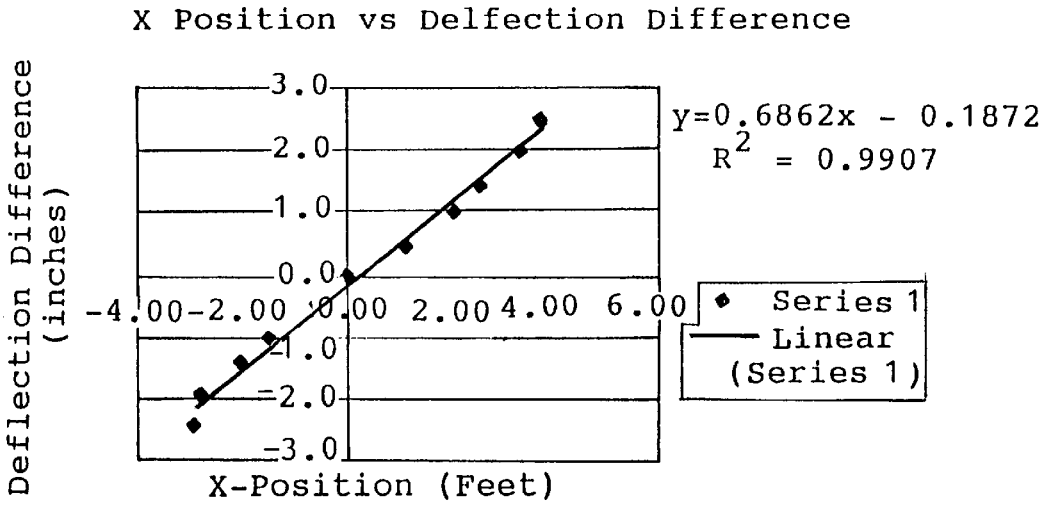
FIG. 3 is a graph showing the relationship between horizontal position (lateral offset, x) and deflection distance difference at the backstop (data points collected using a golf ball attached to a graduated rod and measuring the deflection difference between actuations of the sensing means of FIG. 1 at various backstop positions)

FIG. 3 presents the data of Table 1. The lateral offset position on the net where the deflection forces are applied (x position, measured along a horizontal line) is plotted as a function of the difference in deflection distance (deflection difference Dz). The empirical data essentially produce a straight line, demonstrating that the lateral offset at the net (x position) can be related to the deflection distance difference (deflection difference Dz) by a linear relationship (i.e., $Dz=M^{*}x+B$).

Next consider that instead of measuring the deflection distance difference directly, one measured the time from club impact to the actuations of the two switch sensors 12 and 14 at either side of the net 10. To convert the time difference (Dt) to a distance difference (Dz), one needs to multiply by the velocity V (neglecting the deceleration to confirm the form of the equation). Typically, the time measurements are obtained by counting clock pulses produced with the period P. The calculated difference Dz in deflection distance for the successive switch actuations can be derived from the left and right count measurements, Cl and Cr, as follows:

$$Dt=(Cl-Cr)^{*}P \quad (1)$$

$$Dz=Dt^{*}V \quad (2)$$

These same count measurements can be used to determine the ball velocity, as follows:

$$FlightTime=\tfrac{1}{2}(Cl+Cr)\cdot P \quad (3)$$

$$V=S/FlightTime, \quad (4)$$

where S is the distance from the tee (launch site) to the net 10. Substitution yields:

$$Dz=2\cdot S\cdot(Cl-Cr)/(Cl+Cr) \quad (5)$$

Figure 4:
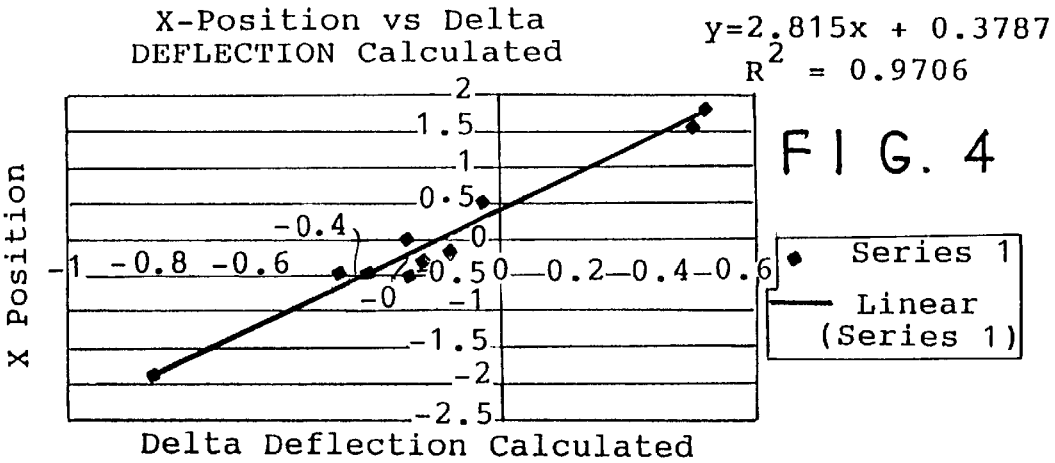
FIG. 4 is a graph showing the relationship between horizontal position (lateral offset, x) and deflection distance difference at the backstop calculated from relative time of actuations of the sensing means of FIG. 1 (data points collected by driving balls into the net (backstop) and determining the impact location by measurement and by derivation from the various sensors—actual positions verified with videotape recordings)

A plot of actual golf shot horizontal impact position (x) against calculated deflection difference (Dz), acquired with the above counting scheme is presented in FIG. 4, using the test data of Table 2. This test was performed with a clock frequency of 1.133 kHz and a tee to backstop distance of 7.5 feet. The test data showed the following linear relation: $x=2.815\cdot Dz+0.3787$. It will be appreciated that other linear relations will plot in different test setups.

TABLE 2

Velocity (V) and Measured and Calculated Lateral Offset (x)

| Left (Cl) | Rt (Cr) | Bott (Cb) | Top (Ct) | V calc | L-R | Dz calc | X calc | X meas |
|---|---|---|---|---|---|---|---|---|
| 149 | 166 | 158 | 151 | 37 | −17 | −0.8095 | −1.9 | −1.9 |
| 104 | 109 | 105 | 106 | 54 | −5 | −0.3521 | −0.6 | −0.5 |
| 117 | 122 | 114 | 113 | 48 | −5 | −0.3138 | −0.5 | −0.5 |
| 116 | 119 | 112 | 116 | 49 | −3 | −0.1915 | −0.2 | −0.5 |
| 120 | 123 | 115 | 115 | 48 | −3 | −0.1852 | −0.1 | −0.3 |
| 119 | 121 | 114 | 114 | 48 | −2 | −0.1250 | 0.0 | −0.1 |
| 132 | 136 | 125 | 122 | 43 | −4 | −0.2239 | −0.3 | −0 |
| 156 | 157 | 153 | 144 | 37 | −1 | −0.0479 | 0.2 | 0.5 |
| 140 | 132 | 137 | 142 | 43 | 8 | 0.4412 | 1.6 | 1.6 |
| 117 | 110 | 127 | 117 | 51 | 7 | 0.4626 | 1.7 | 1.7 |

Figure 6:
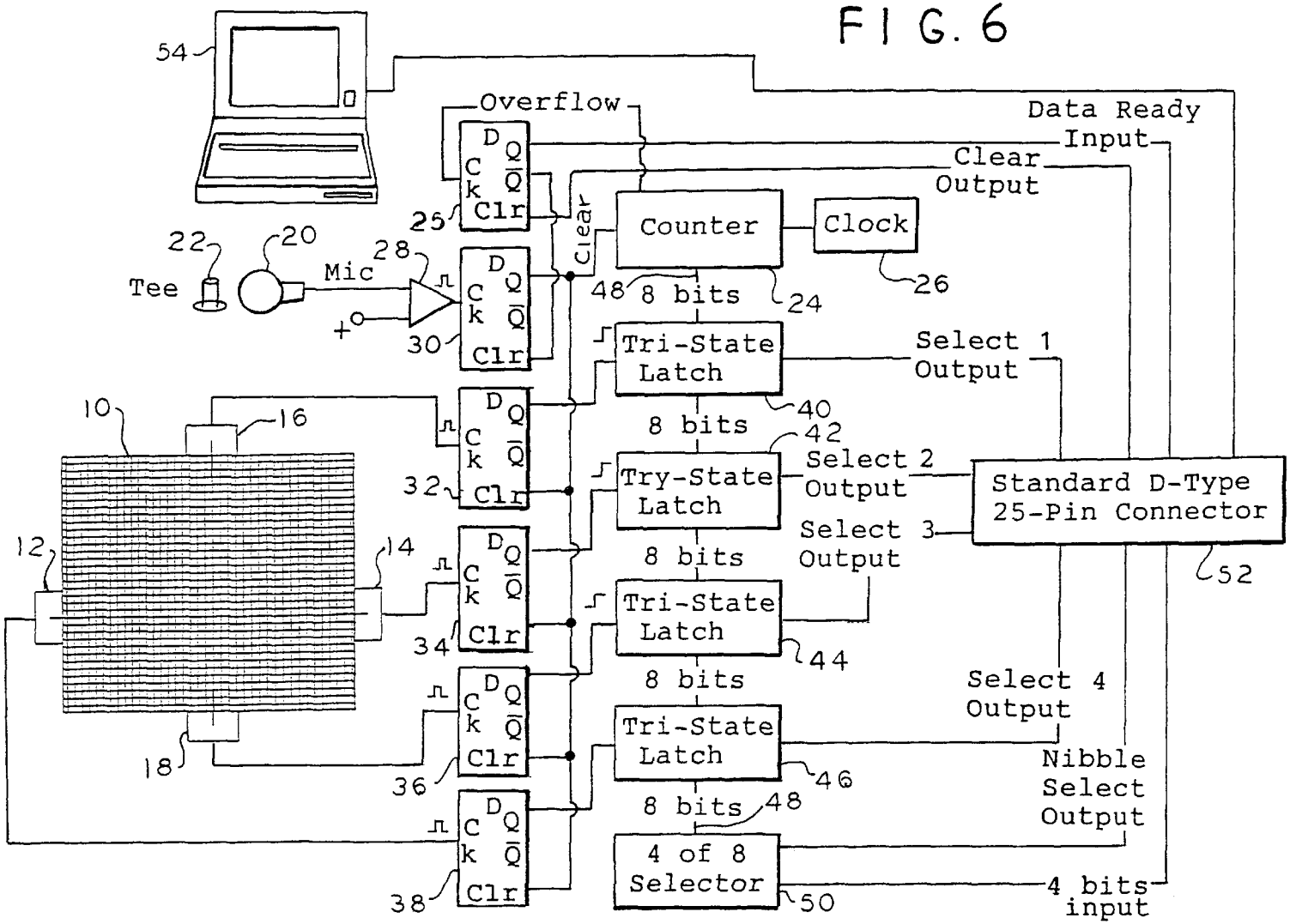
FIG. 6 is a schematic diagram of a game apparatus capable of performing a method, in accordance with principles of the present invention.

Referring to FIG. 6, golf net 10 and sensor switches 12 and 14 are supplemented with top sensor switch 16 and bottom sensor switch 18. Thus net 10 is fitted on the center of each of its four sides with a sensor switch. Also, a microphone 20 is positioned next to tee 22 to detect club impact with the golf ball.

Figure 5:
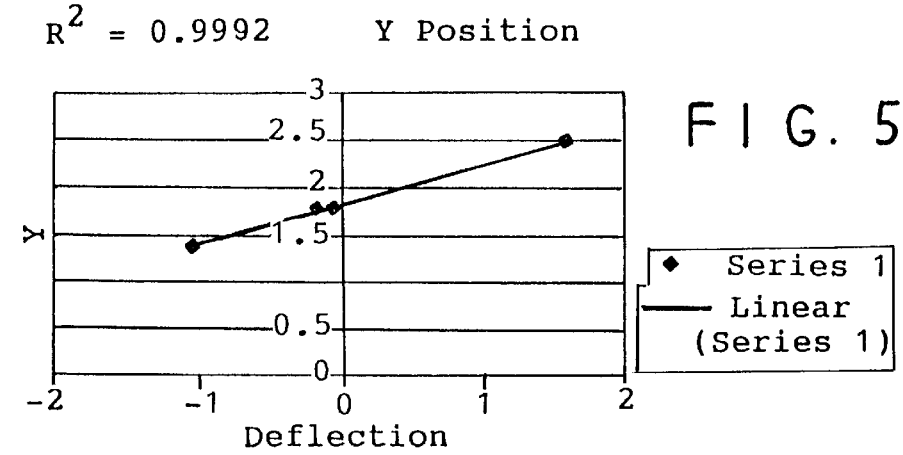
FIG. 5 is a graph showing the relationship between vertical position (vertical offset, y) and deflection distance difference at the backstop calculated from relative time of actuations of the sensing means of FIG. 1 (data points collected by driving balls into the net (backstop) and determining the impact location by measurement and by derivation from the various sensors—actual positions verified with videotape recordings)

Static measurements can be taken for various deflections occurring along a vertical center line, using the sensors 16 and 18 of FIG. 6. Sensors 16 and 18 will be constructed similarly to sensors 12 and 14, except for being located at the center of the top and bottom edges of net 10. Sensors 16 and 18 will not necessarily have the same response as sensors 12 and 14. In fact, in the constructed embodiment, sensors 16 and 18 had a different linear relationship which is plotted in FIG. 5. There, the vertical offset (y) is presented, based upon the test data of Table 3. It can be seen that highly linear relationships are still obtained. FIG. 5 does show that the linear relation for the vertical measurements is different than that obtained for the horizontal measurements. The linear relation for the vertical measurements is best described as follows: $y=0.8388\cdot Dz+1.848$. In any event, these linear relationships allow simple switches to be used to obtain the two-dimensional impact location on a net (x, y) as well as velocity (v).

TABLE 3

Velocity (V) and Measured and Calculated Vertical Offset (y)

| Left Cl | Right Cr | Bottom Cb | Top Ct | V mph | Dz calc | Y calc | Y meas |
|---|---|---|---|---|---|---|---|
| 233 | 224 | 218 | 234 | 25.6 | −0.531 | 1.4 | 1.4 |
| 199 | 220 | 223 | 201 | 27.3 | 0.778 | 2.5 | 2.5 |
| 190 | 200 | 194 | 196 | 29.7 | −0.077 | 1.8 | 1.8 |
| 180 | 187 | 180 | 181 | 32.1 | −0.042 | 1.8 | 1.8 |

The illustrated time count capture system of FIG. 6 can automatically collect measurement data and calibrate a PC-based time capture system. The digital circuit for count capture comprises an 8-bit binary counter 24 (dual 74163s) driven by clock 26 (type LM555). Microphone 20 is shown connected through comparator 28 (¼ of a type LM339) to the clock input Ck of D-type latch 30 (½ of a type 7474), whose Q output is connected to the clear inputs of counter 24 and D-type latches 32, 34, 36, and 38 (type 7474). The clock inputs Ck of latches 32, 34, 36, and 38 are connected to the outputs of sensors 16, 14, 18, and 12, respectively. The overflow output of counter 24 connects to the clock input Ck of D-type latch 25, whose $\overline{Q}$ output connects to the clear input of latch 30, and whose Q output connects to the Data Ready Input line of 25 pin, D-type connector 52.

The outputs Q of latches 32, 34, 36, and 38 connect to triggering inputs of tri-state latches 40, 42, 44, and 46 (type 74374s), which are all commonly connected through an eight-bit bus 48 to counter 24 and 4-of-8 selector 50. Selector 50 (type 74157) can select either the most or least significant four bits on bus 48 and transmit them to connector 52 based on the nibble select output from connector 52. Connector 52 also provides selection signals to each of the four latches 40, 42, 44, and 46.

Club impact with the ball when detected with the microphone 20, produces a microphone signal through comparator 28, which triggers the clock input Ck of latch 30, to set its output Q high and release the clear lines of latches 32–38, thereby enabling them to store their respective counts (FIG. 6). Club impact with the ball, also causes the output Q of latch 30 to enable the counter 24. The counter 24 increments at a rate on the order of 1000 counts per second, as determined by clock 26.

A ball impacting the netting 10 causes the switches 12–18 to actuate in an order depending upon the impact location, and at times depending on the velocity. Each switch actuation is recorded in latches 32–38 to provide a debounced, single positive edge used to capture the count in the corresponding 8-bit latch. The time of actuation of any single net switch can be displayed directly on a 3-digit display (not shown) without a computer; or can be read by a computer as described presently.

The overflow of counter 24 will trigger the input Ck of latch 25 (½ of type 7474) to provide a fifth latched output producing a high signal on its output Q indicating to a computer that data from the circuit is available to trigger data transfer (that is, a data ready input signal). Digital Circuit to PC Interface.

Figure 7:
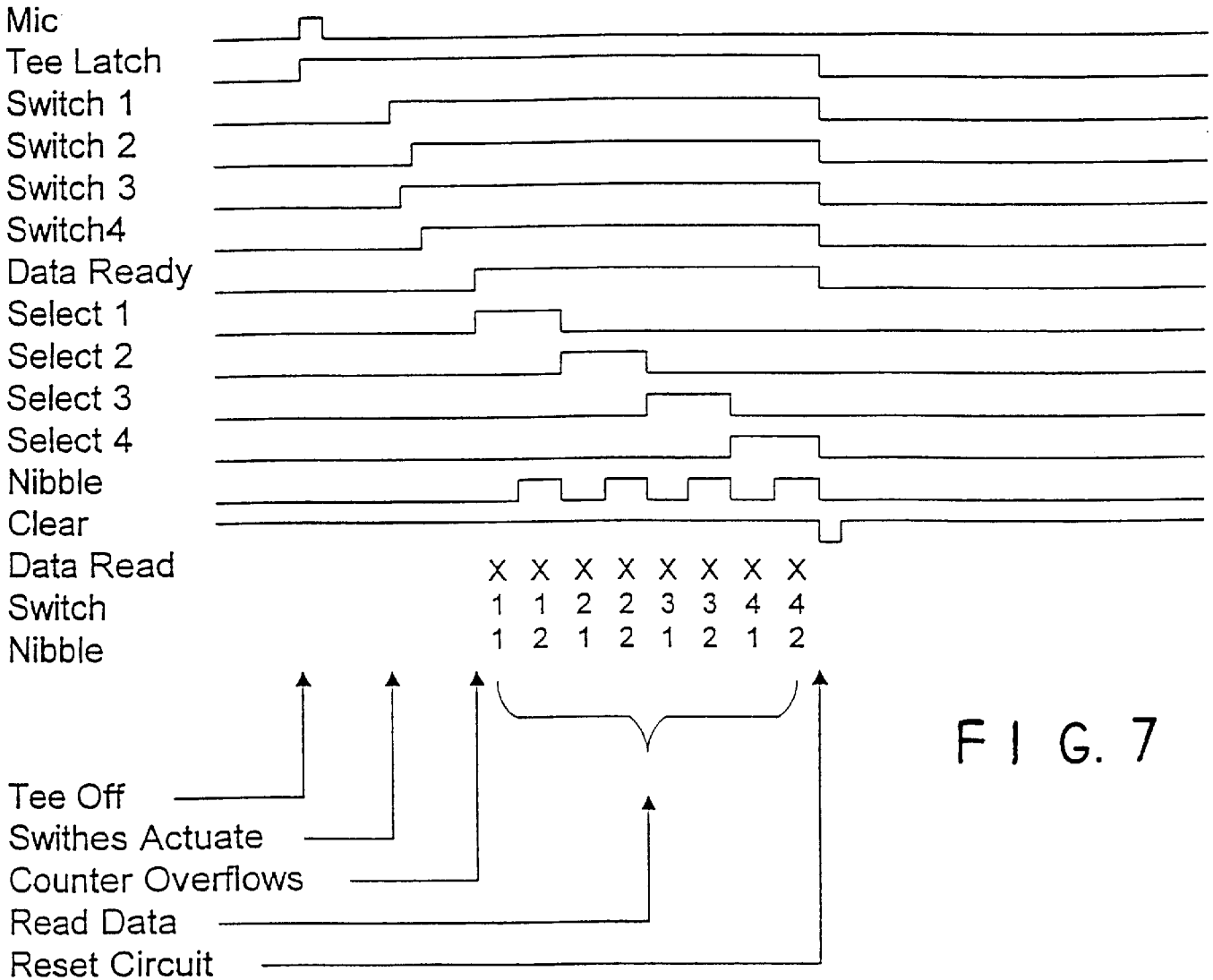
FIG. 7 is a timing diagram associated with the schematic diagram of FIG. 6.

Connector 52 may be plugged into the parallel printer port of a personal computer, such as laptop computer 54. The latched information in latches 40–48 can be transferred using a custom driver routine in computer 54. As many as five status inputs and six digital outputs may be used in the standard parallel port interface (connector 52 of FIG. 6). The custom software driver waits for the data ready signal from the output Q of latch 25 through connector 52. The computer 54 then controls the data transfer one nibble (i.e. 4 bits) at a time. The 8-bit count from the first switch (the data from switch 16 is read first in this example) is placed on the 8-bit bus 48 by the computer 54 sending a low signal on the "select output" line of first latch 40. See FIG. 7. A high level is also sent by the computer 54 to selector 50 to select the upper nibble. The upper nibble of the first count is then read. Then the nibble select signal applied selector 50 is changed to a low by the computer 54 and the lower nibble is then read. The whole count is reassembled in the computer 54 with a binary weight algorithm and the process is repeated for the remaining switches 14, 18, and 12 by reading their latches 42, 44, and 46, respectively. (This is known to those skilled in the art of PC interfacing as the "nibble method" of data transfer to a parallel port.)

When the four counts have been thus obtained, the computer 54 resets the circuit by sending a clear signal to the clear input of latch 25 to cause its $\overline{Q}$ output to go high, which then releases latch 30. In response, the output Q of latch 30 resets latches 32–38, as well as counter 24, which is held at an initial count. Counter 24 and the latches have thus completed the data transfer handshake.

When the numbers are thus read the elapsed time from tee to net is calculated from the average count times and the known clock speed. The velocity is calculated from the stored value of distance from tee to net divided by the time (see for example, equations 1 and 2, above), and the impact location is calculated from the ratio of count difference to count sum (see for example, equation 5, above) applied to the above noted linear relations for the horizontal and vertical positions.

Distance from Velocity and Loft Angle:

The distance traveled by a projectile can be calculated using Newtonian physics, but this treatment neglects the spin, which significantly increases the distance of a golf ball. Empirical relations of distance to velocity for different clubs (i.e. loft angles) were published in a book entitled "The Search for the Perfect Swing" by Cochrin, 1969.

Figure 8:
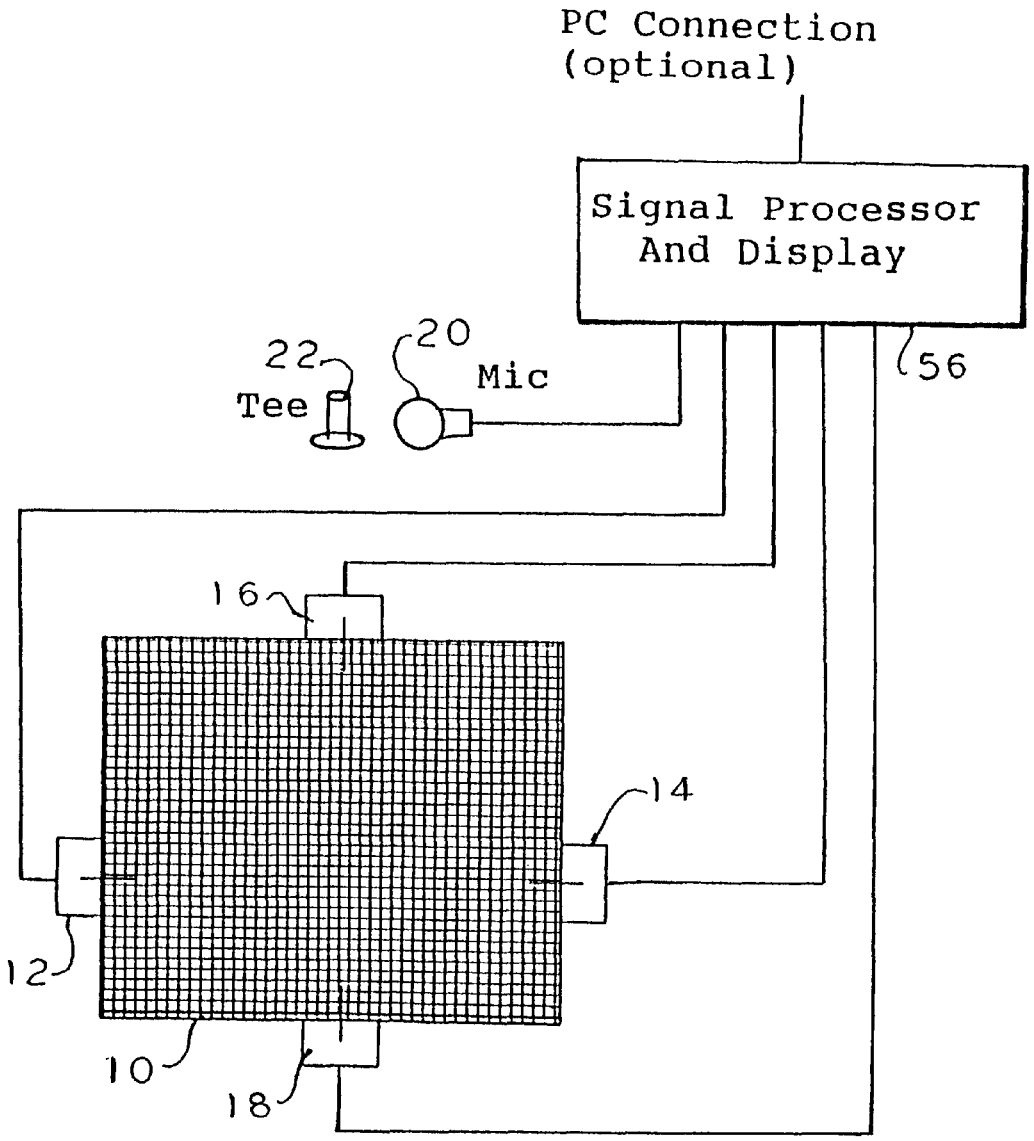
FIG. 8 is a schematic diagram for an apparatus and associated method, which is an alternate to that of FIG. 6.

Without a PC:

Referring to FIG. 8, the simplest embodiment does not require a PC but a connection to a PC is provided as an option. Here, the count from one of the switches 12–18 can be displayed by a dedicated processor/display 56 to provide an indication of the time and the velocity of the drive. In some embodiments, unit 56 will contain a dedicated microprocessor. In order to generate a reading of distance from the time counts, the count could be used to address a value that corresponds to the distance for each count and club number combination. This look-up table approach can be implemented with or without a microprocessor. For example, in one embodiment, the unit 56 can include an EPROM (not shown) to provide the lookup feature. A switch (not shown) in unit 56 can be used to enter the club number. The left and right counts can be compared to indicate the degree of hook or slice. FIG. 8 illustrates that the signals can be used by dedicated circuitry to provide feedback of drive quality without a separate computer.

Figure 9:
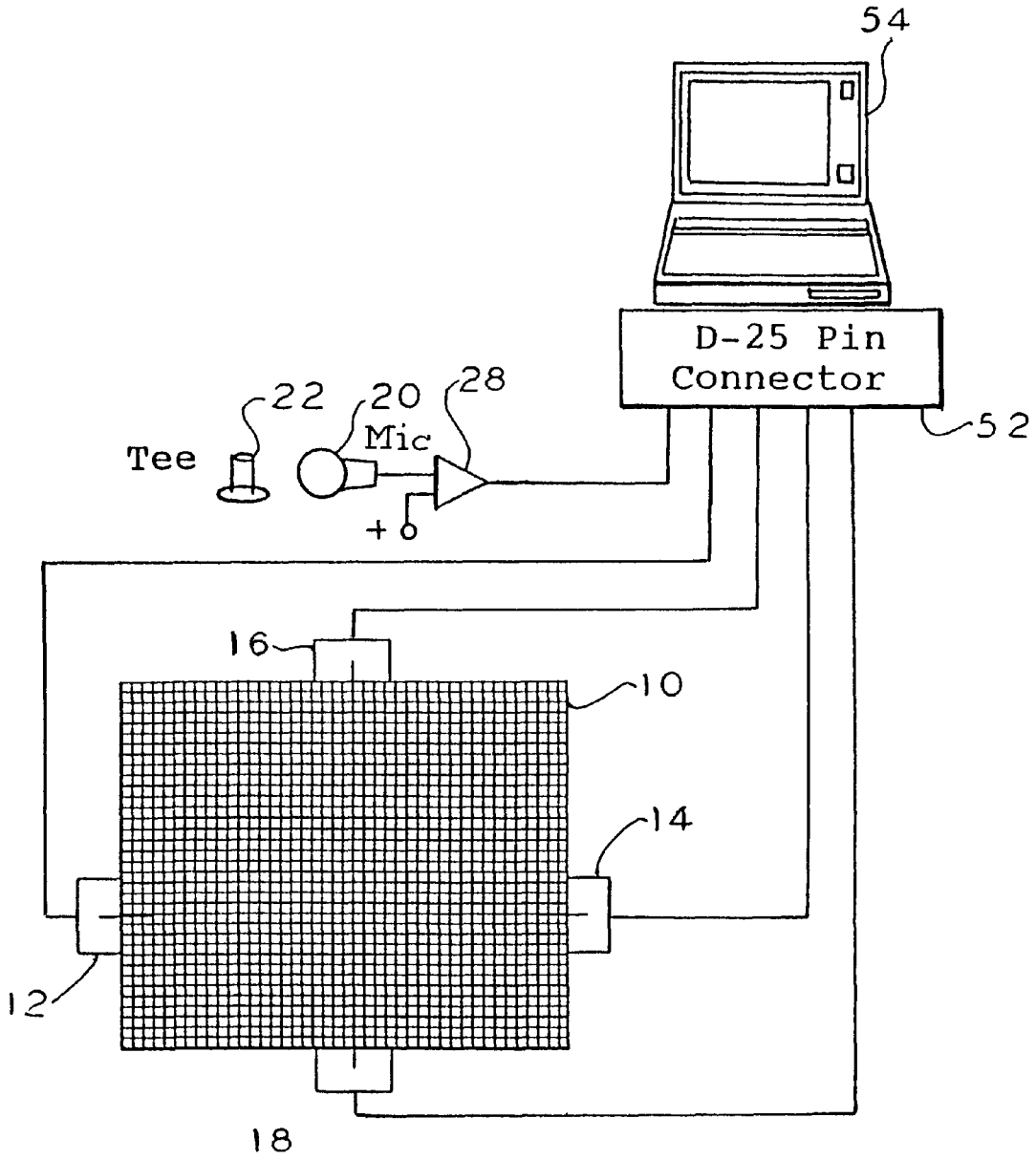
FIG. 9 is a schematic diagram for an apparatus and associated method, which is an alternate to that of FIGS. 6 and 8.

Direct Time Measurement in PC:

Referring to the embodiment of FIG. 9, the sensors switches 12, 14, 16, and 18 are mounted as before on net 10, but now connect directly to previously mentioned 25-pin connector 52. The switches 12–18, as well as previously mentioned microphone 20/comparator 28 are wired through connector 52 to the five status lines of a standard PC parallel port. In this case, a driver routine in computer 54 scans the five inputs every millisecond and records the times from tee impact to switch closures, thus eliminating the counter circuitry of FIG. 6.

Referring to FIGS. 6, 8, 9, and 10, net 10 was, in a constructed embodiment, 8' (2.4 meters) wide by 7' (2.1 meters) high, with a frame fabricated from tubing 57, such as ½" (1.3 cm) iron pipe onto which a standard rectangular golf net was strung. The sensors switches 12, 14, 16, and 18 each have a microswitch, such as switch 60 shown in FIG. 10 with lever arm 62. Switch 60 is bolted to 3" (7.6 cm) lengths of PVC pipe 58. The switch 60 is positioned on the frame so the lever arm 62 is pulled in and slightly back with net deflection upon ball impact. A ⅜" (0.95 cm) wide slot was formed along the length of the PVC pipe 58, so it could be snapped onto the ½" iron net frame 57. Since 2" PVC was used, a spacer (not shown) comprising a 3" (7.6 cm) length of ½" (1.3 cm) pipe was inserted in the PVC pipe as well. The result was a switch holder that was sufficiently secure, but could be conveniently moved along or around the frame as desired.

Tension Adjustment:

Fine tension adjustment from the lever 62 to the netting 10 was provided with a 2" (5.1 cm) set screw 64 threaded through the switch lever arm 62 as shown in FIG. 10. Switches were protected from excessive force using spring 66, which is connected between set screw 64 and net 10 for absorbing excess extension after switch actuation.

Golf Game Simulation:

The measurements of distance and direction can be used to keep track of simulated ball position relative to the tee and a virtual hole some distance away. The game of the present invention allows one to input the yardage to the hole, and an aerial view position is displayed showing ball position between shots until the ball is on the green, or in the hole.

Putt Measurement:

Referring to FIG. 11, putting can be practiced indoors using a conventional indoor putting green, but to simulate a putt with the present invention, a floor-level backstop 68, 70 equipped with two switches 72 and 74 is used. The striking of ball 68 can be detected by microphone 20' (which in some embodiments may be the previously mentioned microphone 20, but repositioned to detect putting). The backstop comprises two sections 68 and 70 angled at ninety degrees, each with a switch sensor 72 and 74, respectively. If the ball strikes the backstop in the center (corner), both switches 72 and 74 actuate at the same time. If impact is off-center, the switch for that side actuates first. The ball is deflected toward the other switch after impact. The further from center, the longer the time lag between switch actuations, thus providing a means to measure accuracy and velocity with the same type of analysis. The switches 72 and 74 are wired in series (normally closed) with the net switches, so the same sensor inputs can be used for the net and putt switches.

Simulator Interface:

Various popular golf simulation games, such as Link Access™, provide excellent golf course simulation on a home PC at a very reasonable cost. The mouse is clicked twice to input both speed and direction for a club. A custom driver can be used to take the sensor generated speed and direction and mimic the mouse operation to provide an interface to the commercial software.

To facilitate an understanding of the principles associated with the foregoing apparatus, its operation will be briefly described. To set up for a game, at least two switches, namely switches 12 and 14 (FIG. 1), are attached to golf net 10, at the left and right sides, about two feet from the ground. Tension is adjusted with set screws 64 (FIG. 10) so both switches 12 and 14 click at about the same time when one pushes the net in at the centerline. The switches 12 and 14 should actuate with less than one foot of deflection (z) into the net. Optionally, two more switches 16 and 18 (FIGS. 6, 8, or 9) can be added at the top and bottom, with tension adjusted so both top and bottom click together when one pushes the net in along the center at a height of about two feet. If top and bottom switches 16 and 18 are not installed, loft angle will be assumed for a given club number.

The drive tee 22 is positioned a known distance from the center of the net 10 (e.g. 7½ feet or 2.3 meters). A microphone 20 is placed within one foot (0.3 meters) of the tee. The putt simulator of FIG. 11 is positioned next to the drive tee area. Cables from the switches 12–18 and microphone 20 plug into a circuit box (not shown) located near the PC 54 (FIGS. 6 or 9). A 25-pin male-male RS-232 connector 52 connects the circuit box to the PC parallel port LPT1. The box is powered with a 9V battery, or an AC-power adapter as desired.

Calibration:

In order for the computer to calculate impact position from tee to net timing, it is first necessary to analyze data point pairs of calculated deflection vs. measured impact locations. Linear regression for the data of the horizontal and vertical axes provides the slope and intercept parameters for the linear calibration equations. The calibration process is software-controlled and can be executed at any time. When executed, the software prompts for calibration shots.

For horizontal position calibration, balls are driven into the net with a lower number iron (e.g. a "3" iron) for easier control at moderate speeds. After each shot, a prompt is generated by the computer requesting the coordinates of the impact location. The operator makes a visual assessment of the impact location and immediately places a marker there on the netting. If the operator cannot do so with an accuracy of an inch or so, the timing measurements for that shot are ignored. If the operator can place the marker accurately, he or she then measures the horizontal distance from the centerline and the height from the floor in inches and enters the coordinates (negative horizontal position indicates left of center).

The object is to obtain a number of data points (e.g. 6 or more) throughout the horizontal range of the net. A graphical display of horizontal position vs. calculated deflection difference is updated after each shot along with the equation of the line and the correlation coefficient. Points can be added or removed as desired. When satisfactory, the calibration process is halted and the calibration factors are stored. The process is repeated for the vertical position, but now an effort is made to strike all balls somewhat along the center line at varying heights by using different irons ("2" through "9") at moderate speed.

Playing the Game:

Software may be written for a Windows™ environment (although other platforms are contemplated). At the start of the game, (or any time during play) one can elect to either use net switch timing or club number to determine the loft angle. If club number is used, the club number entered will always determine the loft angle. If, however, the net switches 16 and 18 are used, the loft angle is computed from the top and bottom switch activation times. If shots are hit far from the vertical centerline, accuracy of the calculated loft angle can be adversely affected. The option to override the calculated loft angle with a club associated loft angle can be selected for any given shot.

The player can run the game in practice mode, single hole mode, or golf course mode. Practice mode displays velocity, loft angle, direction, distance of each shot, along with an aerial-view graphic of final lie, relative to the tee and the green. Single hole mode gives the same information, but additionally keeps track of position from tee to green after each shot. The initial distance from tee to hole can be modified as desired. In course mode, one can continue play with score maintained for multiple holes and multiple players.

Club Selection:

The club number can be selected at any time. It may be entered whether the vertical switches 16 and 18 are in use or not since balls far off from horizontal center may not calculate vertical position very well. In these cases, loft angle will be determined from the club selected.

Initial Ball Position:

The ball can be teed up on a rubber tee or can rest directly on a simulated grass mat, but the distance from ball to net must be constant for accurate velocity calculation.

Data Acquisition:

Clock pulse generator 26 is configured to provide a 1 kH signal, approximately, although other clock speeds are contemplated as well. The clock pulse generator output supplies this constant 1 kHz signal to the counter 24, but the counter is held to a cleared state until the clear inputs (output Q of latch 30) go high upon club-to-ball impact.

Upon striking the ball, a signal on the order of 10–50 millivolts is generated by the microphone 20 (FIGS. 6, 8, or 9). The signal is fed to the non-inverting input of comparator 28 (FIGS. 6 or 9). The reference voltage on the inverting input of the comparator 28 may be taken from a voltage divider (for example a 1 MΩ potentiometer feeding a 470 Ω shunt resistor through a 100 kΩ serial resistor-not shown) for sensitivity adjustment.

When the ball is struck, the signal from microphone 20 is momentarily above the reference voltage, causing the output of comparator 28 to swing momentarily from 0 to the supply voltage. The comparator output is fed to the clock input Ck of the positive-edge-triggered sensor flip-flop 30 (FIG. 6). Upon the positive-edge transition, its output Q goes from ground to the supply voltage and stays at that level because the "D" input is tied to the supply voltage and the latch has previously been cleared. The output Q of this flip-flop 30 goes into the "clear" inputs of the dual 4-bit, synchronous counter 24, which functions as an 8-bit counter. Upon this transition to the high state, the 8-bit counter 24 is enabled and counting can begin.

Counter 24 increments its 8-bit output with each clock pulse. These 8-bits are fed to a data bus 48 to the 8-bit inputs of the four 8-bit tri-state latches 40–46. These latches each store a count when a positive transition is supplied to its latch signal input by flip-flops 32–38. The four net switches 12–18 are normally closed, keeping the input to switch flip-flops 32–38 low until actuation. Upon opening of a contact in one of the switches 12–18, the voltage to the clock input Ck of the corresponding flip-flop 32–38 causes a transition to a high state, as its "D" input is high, and it was previously cleared. Thus, the outputs Q of switch flip-flop 32–38 provide debounced (i.e. single transition) signals to the 8-bit latches 40–46 to store the counts upon switch actuation.

All the switches 12–18 should actuate before the counter 24 overflows. The 8-bit counter overflow will signal PC 54 that new data is available. Specifically, the overflow signal swings to a high state and drives the clock input Ck of "data ready" flip-flop 25. The output Q of this flip-flop is the "Data Ready" signal polled by the PC 54.

The inverted output $\overline{Q}$ from "Data ready" flip-flop 25 is used to reset the circuit by driving the clear input of microphone sensor flip-flop 30. The output Q of this microphone sensor flip-flop 30 is in turn sent to the clear inputs of the four sensor flip-flops 32–38, in addition to the clear input of counter 24. Thus the sensor flip-flops 32–38 are disabled until the microphone sensor flip-flop 30 actuates. When the PC 54 detects that data is available via the "Data Ready" signal (output Q of flip-flop 25), the data transfer is controlled by the PC.

The eight-bit outputs of the tri-state latches 40–46 are all connected to the output bus 48. The output bus 48 leads to the eight-bit inputs of a 4-of-8-bit data selector 50. The four-bit outputs of selector 50 go to the remaining 4 status inputs of the parallel port on connector 52. Upon detecting a high level on the Data Ready input (output Q of flip-flop 25), the computer 54 sets a low level on the "Select 1" output, which goes to the output select of the first switch count storage latch 40. This causes the first count to be placed on the output bus 48 to the 4-of-8 bit selector 50, which passes the lower four bits of the first count to the PC software driver. Then a high level is sent through the nibble select line to the 4-of-8 selector 50 and the upper four bits are read. The lower and upper counts are combined in a binary weight algorithm to obtain the original count.

The computer 54 now resets the "Select 1" signal, and selects the second count with a low level output on the "Select 2" line to the second 8-bit latch 42. The PC 54 also clears the nibble select line to selector 50 and reads the lower nibble of the second count. The process continues to get all four counts, then the computer 54 sends a low pulse on the "Clear" line to the "Data Ready" flip-flop 25, thus re-enabling the microphone and sensors. At this point, the calculations are performed, and the software interface driver resumes polling the "Data Ready" signal to detect another shot.

Calculations:

The four counts thus obtained are used to calculate impact location with linear equations as described previously. The azimuthal deviation angle from center is calculated from the arctan of the ratio of horizontal position to distance from net. The loft angle is similarly calculated from the arctan of the ratio of height to net distance. The actual distance from tee to actuation point is equal to the square root of the sum of the squares of the distance to the net, impact height and impact horizontal position, plus a small distance (e.g. 6 inches) to account for distance into the net before actuation. This is used to calculate the velocity from actual travel distance divided by the average time.

If the loft deviation angle from center is above some preset maximum, the loft angle is determined from the club identity. The unhindered, simulated distance is calculated from the loft angle and velocity, and the final position of the ball relative to the tee and hole is calculated from the distance and the deviation angle. Distance forward is the unhindered calculated distance times the cosine of the azimuthal deviation angle. The distance to the right or left is equal to the distance times the sin of the deviation angle. Thus the new coordinates of the final simulated ball position are obtained.

Putting:

When the putter is the selected club, the software uses a different set of parameters for the calculations. A reduced distance from ball to backstop is used for the velocity calculation, and a zero loft angle is assumed. An analogous calibration technique can be applied to putting, and the alternate linear calibration equation can be implemented by the software to calculate direction. Alternatively, the backstop 68, 70 (FIG. 11) can be designed so that one of five switch sequences indicate five levels of accuracy as follows: (1) just the left switch actuates (far left), (2) the left then the right switch actuate (near left), (3) both actuate at the same time (center), (4) first the right, then left (near right) and (5) just the right switch actuates (far right).

Links Access™ Interface:

Additional software can be executed to mimic the mouse operation that ordinarily controls how the Links Access™ program inputs speed and direction. For each club, there is a linear relation between the time period between initial mouse depression and release and the distance the ball will travel. Thus, the initial mouse depression time can be calculated from the desired distance and the club number. Similarly, the deviation (i.e. hook/slice) angle is determined by the Links Access™ software from the time after the first mouse release And before a second mouse click. Given a desired deviation angle and a known distance, the time before this second mouse click can also be calculated and simulated. This technique has been applied to provide an interface to the Links Access™ software in U.S. Pat. No. 5,826,874, but the principles used there to acquire the speed and direction are completely different from those of the current system. The technique to mimic mouse operation with a computer program is known to those skilled in the art of computer programming.

Local PC-Independent Distance Calculation:

For the alternate embodiment of local processing in FIG. 8, the club number could be selected with, for example, a 9-pole single throw switch (not shown) to enable one of 9 banks of 256×12 bits RAM memory in unit 56. Each memory location may contain the yardage count for the club/velocity count combination, possibly in binary encoded decimal format, and the yardage count would be displayed on a 3-digit LED display independent of the PC. This strategy can be implemented with or without a local microprocessor to provide immediate feedback of distance without a computer. Simple subtraction of left minus right counts can be used to provide a value that can be used to illuminate one of several LEDs to indicate the degree of hook/slice accuracy.

It will be appreciated that various modifications may be implemented with respect to the above described, preferred embodiments. While a net is described, in other embodiments the backstop may be a flexible sheet made of plastic, cloth, or other materials. The illustrated laptop computer can be replaced with a conventional desktop computer, or can be part of a larger, more general purpose computer. Also, additional sensor switches may be employed for redundancy or increased accuracy. Moreover, instead of microswitches, the sensors can employ strain gauges, pressure transducers, piezoelectric crystals, magnetic or optical transducers, or other linear position transducers. Furthermore, in some embodiments the counter can be strobed upon each actuation of the sensor switches, and the resultant count data combined with a switch identification code to format packets that are sent over any one of a number of digital links. Moreover, the illustrated microphone can be replaced with a mechanical vibration sensor, an optical or magnetic transducer, etc. Also, the various steps performed by the computer can be performed with additional or fewer steps, and the steps can be re-ordered in some embodiments. In addition, apparatus of the foregoing type can be employed to measure the flight characteristics of a baseball, tennis ball, hockey puck, or any one of a variety of objects that are propelled by a player.

Obviously, many modifications and variations of the present invention are possible in light of the above teachings. It is therefore to be understood that within the scope of the appended claims, the invention may be practiced otherwise than as specifically described.

What is claimed is:

1. Game apparatus for determining flight characteristics of an object propelled by a player from a launch site toward a backstop, comprising:

a launch detector located at said launch site for producing a launch signal in response to launching of said object;

backstop sensing means located at said backstop and having at least one spaced pair of sensors for producing a pair of arrival signals in response to arrival of said object at said backstop, said sensors being adapted for mounting at opposite edges of said backstop in order to produce said arrival signals in response to inward tension caused by impact of said object with said backstop;

processing means coupled to said launch detector and said backstop sensing means for (a) deriving object velocity from relative response times of said launch detector and said backstop sensing means, and (b) producing a lateral position signal as a function of object velocity and relative arrival times of said pair of arrival signals, the relative arrival times being based on a time differential for successive achievement at opposite edges of said backstop of an inward tension producing a response in excess of a predetermined amount.

2. Game apparatus according to claim 1 wherein said processing means is operable to produce a velocity signal corresponding to flight velocity of said object in response to the relative response times of said launch detector and said backstop sensing means.

3. Game apparatus according to claim 2 wherein said processing means has stored therein a lookup table for correlating response times of said launch detector and said backstop sensing means to said flight velocity.

4. Game apparatus according to claim 2 wherein said velocity signal is produced by said processing means as a function of difference between (a) the response time of said launch detector, and (b) average response time of said pair of arrival signals.

5. Game apparatus according to claim 4 wherein said processing means is operable to produce a deflection signal corresponding to distance traveled by said object at said backstop between occurrence of successive ones of said pair of arrival signals as a function of said velocity signal and the difference in arrival times of said pair of arrival signals.

6. Game apparatus according to claim 1 wherein said processing means is operable to produce a direction signal signifying an offset of said object from center at said backstop as a predetermined function of (a) the relative arrival times of said pair of arrival signals, and (b) the relative response times of said launch detector and said backstop sensing means.

7. Game apparatus according to claim 6 wherein said processing means has stored therein a lookup table for correlating (a) the relative arrival times of said pair of arrival signals, and (b) the relative response times of said launch detector and said backstop sensing means to said direction signal.

8. Game apparatus according to claim 1 wherein said processing means is operable to produce a direction signal signifying an offset of said object from center at said backstop as a predetermined linear function of a ratio of (a) the difference in arrival times of said pair of arrival signals, and (b) difference in response times of said launch detector and said backstop sensing means.

9. Game apparatus according to claim 1 wherein said launch detector is acoustically responsive.

10. Game apparatus according to claim 1 wherein said pair of spaced sensors are positioned at opposite edges of said backstop, an earlier response being produced from that one of said spaced sensors closer to said object upon its impact with said backstop.

11. Game apparatus according to claim 10 wherein said backstop sensing means comprises:

an azimuthally spaced pair of sensors centrally located at right and left edges of said backstop; and an elevationally spaced pair of sensors centrally located at top and bottom edges of said backstop.

12. Game apparatus according to claim 10 wherein said pair of spaced sensors each comprise:

a switch;

a spatially adjustable link means coupled to said switch and adapted to yieldingly attach to said backstop.

13. Game apparatus according to claim 1 wherein said pair of spaced sensors are arranged to successively produce said arrival signals to mark movement of said object at said backstop over a displacement distance having a magnitude that is approximately a linear function of an offset from center of said object at said backstop.

14. Game apparatus according to claim 13 wherein said pair of spaced sensors is located at right and left edges of said backstop.

15. Game apparatus according to claim 14 wherein said spaced pair of sensors comprise:

a pair of switches adapted to be attached to, and actuated by movement of, said backstop.

16. Game apparatus according to claim 15 wherein said spaced pair of sensors are centrally located at left and right edges of said backstop.

17. Game apparatus according to claim 15 wherein said backstop sensing means comprises:

an azimuthally spaced pair of sensors centrally located at right and left edges of said backstop; and an elevationally spaced pair of sensors centrally located at top and bottom edges of said backstop.

18. Game apparatus according to claim 1 wherein said processing means comprises:

timing means for measuring time elapsing (a) between successive responses of said launch detector and said backstop sensing means, and (b) between occurrences of different successive ones of said arrival signals.

19. Game apparatus according to claim 18 wherein said timing means comprises:

a clock for providing periodic pulses;

a counting means coupled to said clock for counting said periodic pulses; and latch means for storing different progressive counts of said counting means in response to said pair of arrival signals.

20. Game apparatus according to claim 19 wherein said processing means comprises:

computer means coupled to said timing means for reading counts stored in said latch means.

21. Game apparatus according to claim 1 wherein said processing means comprises:

a computer for measuring time elapsing (a) between successive responses of said launch detector and said backstop sensing means, and (b) between occurrences of different successive ones of said arrival signals.

22. Game apparatus according to claim 1 wherein said object is a golf ball and wherein said processing means comprises:

computer means having a program for simulating a golf game by estimating distance and direction potentially traveled by said golf ball and presenting an interface displaying results of play.

23. Game apparatus according to claim 22 wherein said interface presents a plurality of images representing successive golf scenes indicating the results of play.

24. Game apparatus according to claim 22 wherein said computer means has (a) a golf simulation program adapted to respond to a computer pointing device, (b) an estimating program for estimating distance and direction potentially traveled by said golf ball in response to said launch signal and said arrival signals, and (c) a conversion program for converting direction and distance estimated by said estimating program to emulate a computer pointing device for providing input to said golf simulation program.

25. Game apparatus according to claim 22 comprising:

a pair of putting barriers angled to deflect a completed putt from one of the barriers to the other;

a putt detector located at a starting site for producing a putt signal in response to putting of said golf ball;

detecting means having a pair of barrier sensing means separately located at different respective ones of said pair of putting barriers for producing a pair of impact signals in response to impact of said golf ball with said putting barriers, said processing means being coupled to said putt detector and said detecting means for (a) evaluating a difference in response times of said putt detector and said detecting means, and (b) producing a characterizing signal as a function of the difference in arrival times of said pair of impact signals.

26. A game method of determining flight characteristics of an object propelled by a player from a launch site toward a backstop having a spaced pair of backstop sensors, comprising the step of:

producing a launch signal in response to launching of said object;

deriving object velocity from relative time between said launch signal and a response of at least one of said pair of backstop sensors at opposite edges of said backstop in response to inward tension caused by impact of said object with said backstop; and generating a lateral position measurement as a function of object velocity and response time period of said pair of backstop sensors relative to launch detection by sensing a time differential for successive achievement at opposite edges of said backstop of an inward tension producing a response in excess of predetermined amount.

27. A game method according to claim 26 wherein the step of determining the time elapsing between said launch signal and the response of at least one of said pair of backstop sensors, includes the step of:

producing a velocity signal corresponding to flight velocity of said object.

28. A game method according to claim 27 wherein the step of producing the velocity signal is performed by:

looking up the velocity signal on a predetermined table using response time of said launch signal and response time of at least one of said backstop sensors.

29. A game method according to claim 27 wherein said velocity signal is produced as a function of time difference between (a) the launch signal, and (b) an average response time of said backstop sensors.

30. A game method according to claim 29 comprising the step of:

producing a deflection signal corresponding to distance traveled by said object at said backstop between successive responses of said pair of backstop sensors as a function of said velocity signal and the difference in response times of said pair of backstop sensors.

31. A game method according to claim 26 comprising the step of:

producing a direction signal signifying an offset of said object from center at said backstop as a predetermined function of (a) relative response times of said pair of backstop sensors, and (b) relative response times of said launch signal and at least one of said backstop sensors.

32. A game method according to claim 31 the step of producing the direction signal is performed by:

looking up the direction signal on a predetermined table using (a) the relative response times of said pair of backstop sensors, and (b) the relative response times of said launch signal and at least one of said backstop sensors.

33. A game method according to claim 26 comprising the step of:

producing a direction signal signifying an offset of said object from center at said backstop as a predetermined linear function of a ratio of (a) difference in response times of said pair of backstop sensors, and (b) the time elapsing between said launch signal and the response time of at least one of said backstop sensors.

34. A game method according to claim 26 wherein said launch signal is acoustically responsive.

35. A game method according to claim 26 comprising the step of:

arranging said pair of backstop sensors to respond successively in order to mark movement of said object at said backstop over a displacement distance having a magnitude that is approximately a linear function of an offset from center of said object at said backstop.

36. A game method according to claim 35 comprising the step of:

arranging said pair of backstop sensors to right and left edges of said backstop.

37. A game method according to claim 35 employing a pair of height sensors, and comprising the steps of:

azimuthally spacing said pair of backstop sensors centrally at right and left edges of said backstop; and elevationally spacing said pair of height sensors centrally at top and bottom edges of said backstop.

38. A game method according to claim 26 comprising the steps of:

measuring time elapsing (a) between said launch signal and at least one of said backstop sensors, and (b) between successive responses from different ones of said backstop sensors.

39. A game method according to claim 26 wherein said object is a golf ball and wherein the method includes the step of:

simulating a golf game with a computer by estimating distance and direction potentially traveled by said golf ball and presenting an interface displaying results of play.

40. A game method according to claim 39 comprising the step of:

presenting a plurality of images representing successive golf scenes indicating the results of play.

41. A game method according to claim 39 employing a computer and comprising the steps of:

loading on said computer a golf simulation program adapted to respond to a computer pointing device, loading on said computer an estimating program for estimating distance and direction potentially traveled by said golf ball in response to said launch signal and responses of said backstop sensors; and converting direction and distance estimated by said estimating program to emulate a computer pointing device for providing input to said golf simulation program.

42. A game method according to claim 39 employing a pair of putting barriers angled to deflect a completed putt from one of the barriers to the other, the method comprising the steps of:

producing a putt signal in response to putting of said golf ball;

producing a pair of impact signals in response to impact of said golf ball with said putting barriers, evaluating time elapsing between said putt signal and at least one of said impact signals; and producing a characterizing signal as a function of a difference in arrival times of said impact signals.

* * * * *